US007160175B2

(12) United States Patent
Kamiya et al.

(10) Patent No.: US 7,160,175 B2
(45) Date of Patent: Jan. 9, 2007

(54) ATTITUDE CONTROL DEVICE AND PRECISION MACHINING APPARATUS

(75) Inventors: Sumio Kamiya, Toyota (JP); Hisao Iwase, Aichi (JP); Tetsuya Nagaike, Toyota (JP); Hiroshi Eda, Ibaraki (JP); Libo Zhou, Hitachi (JP)

(73) Assignee: Toyota Jidosha Kabushiki Kaisha, Aichi (JP)

( * ) Notice: Subject to any disclaimer, the term of this patent is extended or adjusted under 35 U.S.C. 154(b) by 0 days.

(21) Appl. No.: 11/316,906

(22) Filed: Dec. 27, 2005

(65) Prior Publication Data

US 2006/0234603 A1 Oct. 19, 2006

(30) Foreign Application Priority Data

Dec. 28, 2004 (JP) ..... 2004-379810

(51) Int. Cl.
*B24B 51/00* (2006.01)

(52) U.S. Cl. ..... 451/11; 451/331; 451/392

(58) Field of Classification Search ..... 451/8, 451/9, 10, 11, 5, 12, 24, 331, 334, 364, 392, 451/393, 411

See application file for complete search history.

(56) References Cited

U.S. PATENT DOCUMENTS

2002/0188370 A1* 12/2002 Saldana et al. ..... 700/121
2006/0000378 A1* 1/2006 Kubo ..... 101/477
2006/0009125 A1* 1/2006 Okura ..... 451/5

FOREIGN PATENT DOCUMENTS

EP 1 034 885 A2 9/2000
JP 2000-141207 5/2000
JP 2001-265441 9/2001
JP 2001-328065 11/2001
JP 2002-127003 5/2002

OTHER PUBLICATIONS

EPO Search Report for Appln. No. 05257937.2-2302; dated Apr. 4, 2006; 3 pages.

* cited by examiner

*Primary Examiner*—Jacob K. Ackun, Jr.
(74) *Attorney, Agent, or Firm*—Finnegan, Henderson, Farabow, Garrett & Dunner LLP

(57) ABSTRACT

An attitude control device and a precision machining apparatus capable of accurately controlling the attitude of an object mounted on the attitude control device according to grinding stages. The attitude control device is constituted by a first flat-plate member 21 and a second flat-plate member 22 disposed in parallel with the first flat-plate while being spaced apart from the same by a distance L. A spherical member 3 is interposed between the first and second flat-plate members 21, 22 while fitting its portions in recesses 21*a*, 22*a* respectively formed in the first and second flat-plate members 21, 22. A first actuator 4*a* expandable in a Z-axis direction perpendicular to a plane defined by an X-axis and a Y-axis is interposed between the flat-plate members. Second actuators 4*b*, 4*b* expandable in a suitable direction in the plane defined by the X-axis and the Y-axis are connected to the second flat-plate member 22. The second flat-plate member 22 is movable relative to the first flat-plate member while being in an attitude with an object mounted thereon. The spherical member 3 is bonded to the first and second flat-plate members 21, 22 by an adhesive 6 elastically deformable.

4 Claims, 2 Drawing Sheets

ATTITUDE CONTROL DEVICE AND PRECISION MACHINING APPARATUS

BACKGROUND OF THE INVENTION

1. Field of the Invention

The present invention relates to an attitude control device used for working on an object such as a silicon wafer or a magnetic disk substrate of which high shape/size accuracy and high flatness of a finished surface are required, and to a precision machining apparatus equipped with the attitude control device. More particularly, the present invention relates to an attitude control device and a precision machining apparatus capable of controlling the attitude of an object mounted on the attitude control device with high accuracy according to grinding stages.

2. Background Art

There has recently been an increasing demand for reducing energy loss in next-generation power devices while reducing the size of the devices. An example of such a demand includes a demand for increasing the number of layers in a semiconductor multilayer structure for electronics purposes and increasing the packaging density of semiconductor devices. Examples of methods conceivable as measures to meet such a demand include a method for reducing the thickness of semiconductor wafers typified by a silicon wafer to an extremely small value, a working method which prevents dislocation and lattice strain in a worked surface and a portion below a worked surface, and a working method which reduces the surface roughness (Ra) to a value in a range from the subnanometer (nm) level to the nanometer (nm) level and reduces the flatness of a worked surface to a value in a range from the submicrometer (μm) level to the micrometer (μm) level or a lower range.

In the motor vehicle industry, an integrated bipolar transistor (IGBT) which is a power device for motor vehicles forms an essential system in inverter systems. A further improvement in marketability of hybrid vehicles achieved by improving the performance of an inverter using the IGBT and by reducing the size of the inverter is being expected. Reducing the thickness of the Si wafer constituting the IGBT to 50 to an extremely small value of about 150 μm, preferably 80 to 140 μm, more preferably 90 to 120 μm to reduce switching loss, steady loss and thermal loss is indispensable to improving the inverter. Further, an improvement in yield in a process step of forming electrodes on the semiconductor and an increase in the number of layers in the semiconductor multilayer structure can be achieved by forming a perfect surface with no dislocation and no lattice strain in a worked surface of a circular Si wafer having a diameter of 200 to 400 mm or in an internal portion in the vicinity of the worked surface and by reducing the surface roughness (Ra) to a value in a range from the subnanometer level to the nanometer level and the flatness to a value in a range from the submicrometer level to the micrometer level.

In ordinary cases under present circumstances, a multistep process including rough grinding using a diamond grinding wheel, lapping, etching and wet chemo-mechanical polishing (wet-CMP) using a loose abrasive is required for the above-described semiconductor working process. It is extremely difficult to obtain a perfect surface by the conventional working method using such process steps, since an oxide layer, dislocation and lattice strain are produced in the worked surface. Also, the flatness of a wafer worked by the conventional method is low and a break in the wafer may be caused during working or after electrode formation, which leads to a reduction in yield. Further, in the conventional working method, the difficulty in reducing the wafer thickness to an extremely small value is increased with the increase in wafer diameter to 200 mm, to 300 mm and to 400 mm. Studies are presently being conducted to reduce the thickness of a wafer having a diameter of 200 mm to the 100 μm level.

There has been a demand for developing a device (attitude control device) capable of accurately moving a rotary device supporting an object to be ground such as a silicon semiconductor wafer by an extremely small distance when the above-described super-precision working is performed on the Si semiconductor wafer. This demand is based on the fact that the accuracy with which the surface of an object to be ground is ground with a grinding wheel cannot be improved without suitably correcting a misalignment between the axes of the grinding wheel and the object to be ground which occurs during the grinding process in addition to initialization for aligning the grinding wheel and the object to be ground.

A method of using a servo motor, a method of using a piezoelectric actuator using a piezoelectric element, a method of using a super-magnetostrictive actuator and the like are generally being practiced as a means for moving or displacing an object through a comparatively small distance with accuracy. If the above-described attitude control device is operated by a servo motor, it is difficult to implement the attitude control device because of a limit to the output performance of the servo motor. It is extremely difficult to perform control with accuracy on the order of nanometers if a servomotor or any other device using rotational motion is used. In a case where the attitude control device is operated by an piezoelectric actuator using a piezoelectric element, there is a problem that the element itself may be broken if it is used to displace a large-load object such as a rotary device used for grinding.

In view of the above-described problems of the conventional art, the inventors of the present invention made a study of an apparatus for accurately moving a large-load object on the order of tons with high accuracy on the nanometer or angstrom level, and developed an elastically displaceable table finely displaceable without friction by considering that in the case of mounting a large-load working unit on the order of tons on the elastically displaceable table displaceable without friction, a displacement of the working unit in a direction perpendicular to the direction of gravity is not influenced by the weight of the mounted object. An invention using this elastically displaceable table is disclosed in JP Patent Publication (Kokai) No. 2001-265441 A. This invention is constituted by the elastically displaceable table displaceable without friction and a super-magnetostrictive actuator. The elastically displaceable table is displaced through deformation of a rod provided on the super-magnetostrictive actuator to perform positioning. The elastically displaceable table displaceable without friction is constituted by a frame and elastically displaceable supports. The frame is mounted on a base by means of the supports. The supports are formed of a material having impact resilience like a spring and having a strength high enough to support an object weight on the order of tons. A plurality of super-magnetostrictive actuators are attached to end surfaces of the frame. A magnetic field excited by application of a current based on a position command value acts on each super-magnetostrictive element to cause the element to expand.

The inventors of the present invention also discloses in JP Patent Publication (Kokai) No. 2002-127003 A an invention relating to an attitude control device (a precision machining apparatus having the attitude control device) incorporating a control system to compensate for a response delay due to a hysteresis characteristic of the above-described super-magnetostrictive element, and a super-magnetostrictive actuator capable of preventing a reduction in accuracy due to joule heat or eddy current produced from a coil of the super-magnetostrictive actuator. The control system that compensates for a response delay due to a hysteresis characteristic uses a hysteresis model expressed by a mathematical function (a straight-line function, a circular-arc function, a spline function or the like), preferably an inverse model based on a Preisach model, which is a model for prediction of a change in a magnetized state of a magnetic material. In this attitude control device, two plates are connected by one connection member in a state of being spaced apart from each other. A super-magnetostrictive actuator is provided at one side of the upper plate perpendicular to a side closer to the connection member. Two super-magnetostrictive actuators are provided below a side of the upper plate opposite from the side closer to the connection member. The connection member is formed of a material elastically deformable and having a strength high enough to support an object weight on the order of tons, as is the corresponding member in JP Patent Publication (Kokai) No. 2001-265441 A. In this invention, the motions of the three super-magnetostrictive actuators are controlled so as to correct a fine misalignment between a grinding wheel axis and a work axis in a three dimensional space.

Each of the fine positioning device disclosed in JP Patent Publication (Kokai) No. 2001-265441 A and the attitude control device disclosed in JP Patent Publication (Kokai) No. 2002-127003 A is capable of accurately controlling positioning of an object having a comparatively large weight (e.g., a rotary device for grinding with a grinding wheel) while supporting the object. However, the two super-magnetostrictive actuators and one support (or connection member) are interposed between the two plates in these devices, and restraint by the support (or the connection member) on the movement of one of the plates relative to the other cannot be avoided since the support (or the connection member) is an elastic member of high strength. That is, if the strength of this member is higher, the movement of the plate in a direction perpendicular to the axis is restrained more strongly. The freedom of movement of the plate on the moving side is limited by this restraint. Also, if the plate is moved only by the super-magnetostrictive actuators, there is a problem that heat produced from the super-magnetostrictive actuators affects other component parts of the positioning device (attitude control device) and damage to the other component parts or a reduction in attitude control accuracy may result.

SUMMARY OF THE INVENTION

In view of the above-described problems, an object of the present invention is to provide an attitude control device capable of accurately controlling of the attitude of an object having a comparatively large weight, e.g., a rotary device for grinding with a grinding wheel without putting any substantial restraint on the movement of one plate displaced relative to another plate while supporting the object. Another object of the present invention is to provide an attitude control device capable of selecting the output level of an actuator according to working stages. Still another object of the present invention to provide a precision machining apparatus equipped with the attitude control device according to at least one of the above objects to realize grinding with high accuracy.

To achieve the above-described objects, according to the present invention, there is provided an attitude control device used to control the attitude of a mounted object, the attitude control device including a first flat-plate member extending in a plane defined by an X-axis and a Y-axis, a second flat-plate member disposed in parallel with the first flat-plate member while being spaced apart from the same, recesses being formed in surfaces of the two flat-plate members facing each other, a spherical member interposed between the first flat-plate member and the second flat-plate member while fitting its portions in the recesses, a first actuator which is interposed between the first flat-plate member and the second flat-plate member, and which is expandable in a Z-axis direction perpendicular to the plane defined by the X-axis and the Y-axis, and a second actuator which is connected to the second flat-plate member, and which is expandable in a suitable direction in the plane defined by the X-axis and the Y-axis, wherein the second flat-plate member is movable relative to the first flat-plate member while being in an attitude with an object mounted thereon, and the spherical member is bonded to the first flat-plate member and/or the second flat-plate member by an adhesive elastically deformable.

Each of the first flat-plate member and the second flat-plate member is formed of a material having a strength high enough to support the weight of an object mounted on the second flat-plate member. Preferably, this material is non-magnetic. This material is not limited to a particular one. However, austenitic stainless steel (SUS) may be used.

The spherical member interposed between the first flat-plate member and the second flat-plate member is also formed of a material having a strength high enough to support at least the weight of the object mounted on the second flat-plate member. Therefore, the material forming the spherical member according to the set weight of the mounted object may also be selected from various materials. Example of the material of the spherical member includes a metal.

Recesses are formed as portions of the first flat-plate member and the second flat-plate member to be brought into contact with the spherical member. The spherical member is interposed between the flat-plate members, with portions of the spherical member fitted in the recesses. The size of the recesses (depth, opening diameter and the like) is suitably adjusted according to the sizes of the flat-plate members and the spherical member and the required attitude control accuracy for example. However, it is required that a predetermined spacing is maintained at least between the first flat-plate member and the second flat-plate member in the stage where the portions of the spherical member are fitted in the recesses of the two flat-plate members. This spacing is set to such a value that the second flat-plate member does not contact the first flat-plate member even when it is inclined by the operation of the second actuator.

The surfaces of the recessed portions of the two flat-plate members facing each other and the spherical member may be bonded by an adhesive. As this adhesive, a suitable adhesive having such a property as to be elastic at ordinary temperature may be used. For example, an elastic epoxy adhesive or any other elastic adhesive may be used. For example, an adhesive having a tensile shear strength of 10 to 15 Mpa, an attenuation coefficient of 2 to 7 Mpa·sec, preferably 4.5 Mpa sec and a spring constant of 80 to 130

GN/m, preferably 100 GN/m may be used. The thickness of the adhesive film may be set to about 0.2 mm.

A mode of implementation in which a recess is formed in only one of the first flat-plate member and the second flat-plate member, a portion of the spherical member is fitted in the recess, and the recessed surface and the spherical member are bonded by an adhesive is conceivable as well as that in which recesses are formed in the two flat-plate members.

A mode of implementation of the attitude control device is conceivable in which the spherical member and two first actuators are interposed between the first flat-plate member and the second flat-plate member at positions corresponding to vertices of a triangle freely selected in a plane, as seen in plan. A mode of implementation of the present invention is conceivable in which the second actuator is attached to the second flat-plate member at least at one of four edges of the second flat-plate member. If at least these three actuators are used, the second flat-plate member can be three-dimensionally displaced relative to the first flat-plate member while being in an attitude with the object directly mounted thereon. When the second flat-plate member is displaced, the adhesive on the surface of the spherical member supporting the second flat-plate member from below is elastically deformed to achieve free displacement of the second flat-plate member substantially free from restraint.

Preferably, each of the first and second actuators has at least a super-magnetostrictive element. The super-magnetostrictive element is an alloy of a rare-earth metal such as dysprosium or terbium and iron or nickel. The super-magnetostrictive element in the form of a rod can expand by about 1 to 2 μm under a magnetic field produced by applying a current to a coil around the super-magnetostrictive element. This super-magnetostrictive element has such a characteristic as to be usable in a frequency region of 2 kHz or lower and has a picosecond ($10^{-12}$ sec) response speed and output performance of about 15 to 25 kJ/cm$^3$, e.g., about 20 to 50 times higher than that of the piezoelectric element described below.

Another mode of implementation of an attitude control apparatus of the present invention is conceivable in which a film is formed by the above-described adhesive on the surface of the spherical member, and the spherical member and the film of the adhesive are separated to be movable relative to each other.

The adhesive is made of an elastically deformable material described above. For example, a film formed of this adhesive may be formed on the surface of a metallic spherical member. To reduce the degree of restraint against the second flat-plate member, the spherical member and the adhesive on the outer peripheral surface of the spherical member are separated from each other in the present invention. For example, a graphite film is formed on the surface of the spherical member and a film formed by the adhesive is formed on the outer peripheral surface of the graphite film. The adhesive and the graphite film do not adhere to each other. The adhesive and the graphite film are made substantially separate from each other. Therefore, when the second flat-plate member is displaced, the spherical member can rotate in an unrestrained condition in the fixed position, while the adhesive in the surface layer deforms elastically in response to the deformation of the second flat-plate member without being restrained by the spherical member.

In the present invention, a suitable flat-plate member, an adhesive and a spherical member (film on the surface of the spherical member) for realizing the first flat-plate member, the adhesive bonded to the first flat-plate member and the spherical member (or the film on the surface of the spherical member) not bonded to the adhesive are provided. The degree of restraint on the movement of the second flat-plate member is reduced to realize extremely fine real-time movement required of the attitude control device. Further, since the degree of restraint on the second flat-plate member is close to the unrestrained state, the energy required of the second actuator at the time of displacement of the second flat-plate member can be reduced in comparison with the conventional art.

In a preferred embodiment of the attitude control device in accordance with the present invention, a piezoelectric element and a super-magnetostrictive element are provided in each of the first actuator and the second actuator.

The material and performance of the super-magnetostrictive element are as described above. The piezoelectric element is formed of lead zirconate titanate ($Pb(Zr,Ti)O_3$), barium titanate ($BaTiO_3$), lead titanate ($PbTiO_3$) or the like. The piezoelectric element has such a characteristic as to be usable in a frequency region of 10 kHz or higher and as a nanosecond ($10^{-9}$) response speed. The output power of the piezoelectric element is lower than that of the super-magnetostrictive element and is suitable for high-precision positioning control (attitude control) in a comparatively light load region. The piezoelectric element referred to herein also comprises an electrostrictive element.

According to the present invention, the super-magnetostrictive element and the piezoelectric element in each actuator can be selectively used as required according to the weight of the mounted object and grinding stages. Therefore, the influence of heat generated in the case of using only the super-magnetostrictive element can be effectively reduced. Since each of the super-magnetostrictive element and the piezoelectric element has a high response speed, the super-magnetostrictive element and the piezoelectric element are selectively used in the present invention in such a manner that while the piezoelectric element is used in principle, the super-magnetostrictive element is used when required. Since the two elements can be selectively used, the energy efficiency during actuator operation can be improved.

According to the present invention, there is also provided a precision machining apparatus including a first rotary device for rotating a grinding wheel, a first pedestal supporting the first rotary device, a second rotary device for rotating an object to be ground, and a second pedestal supporting the second rotary device, wherein the above-described attitude control device is provided between the first rotary device and the first pedestal or between the second rotary device and the second pedestal.

The present invention relates to a precision machining apparatus obtained by applying the above-described attitude control device to a grinding unit. This precision machining apparatus is capable of consistently performing a process from rough grinding to super-precision grinding on an object to be ground by using this unit. An arrangement in which the attitude control device is mounted on a pedestal is adopted to improve the grinding accuracy.

A grinding method using the precision machining apparatus of the present invention is not particularly specified. For example, a grinding method including a rough grinding step using a diamond wheel and a final grinding step using a bonded abrasive (a CMG grinding wheel). The bonded abrasive (CMG grinding wheel) is an abrasive for a grinding wheel used when final grinding is performed as chemo mechanical grinding (CMG). This method is used for performing only a grinding process using a CMG grinding wheel instead of the multistep process including etching, lapping and polishing in the conventional art. The development of the CMG method is presently being pursued. Use of the attitude control device ensures that a small misalignment between the axes of the grinding wheel and the object to be ground resulting from a displacement due to heat or vibration generated by a mechanical factor or friction which accompanies working. At the time of rough grinding, there is a need to comparatively largely move the second flat-plate member (since grinding to a predetermined depth is performed by pressing the grinding wheel against the object to ground) and, therefore, a high-output super-magnetostrictive element is expanded. At the time of final grinding, there is no need to largely move the second flat-plate member (since for example grinding is performed at a predetermined constant pressure) and, therefore, a piezoelectric element of a comparatively low output is expanded. In this way, grinding with high energy efficiency can be achieved.

Further, a small misalignment between the axes is detected at all times. The detected small misalignment is processed by numeric processing in a computer to be input as a necessary amount of expansion to each of the super-magnetostrictive element (super-magnetostrictive actuator) and the piezoelectric element (piezoelectric actuator).

As can be understood from the above, the spherical member covered with an elastically deformable adhesive is interposed between the flat-plate members disposed in parallel with each other to enable the flat-plate members movable relative to the other to move freely without any substantial restraint. Therefore, it is possible to achieve real-time movement of the flat-plate member according to the operation of the actuators without requiring any excessively high output energy of the actuators. Also, the movement of the flat-plate member is controlled by the actuators having super-magnetostrictive elements and piezoelectric elements in the attitude control device of the present invention and, therefore, these elements can be selectively used with respect to working stages, thereby minimizing the influence of heat generated from the super-magnetostrictive elements and improving the energy efficiency. Also, the precision machining apparatus of the present invention equipped with the above-described attitude control device is capable of real-time correction of a misalignment between the axes of the grinding wheel and the object to be ground through the entire process and therefore enables the object to be ground to be finished with high accuracy.

DETAILED DESCRIPTION OF THE PREFERRED EMBODIMENTS

Figure 1:
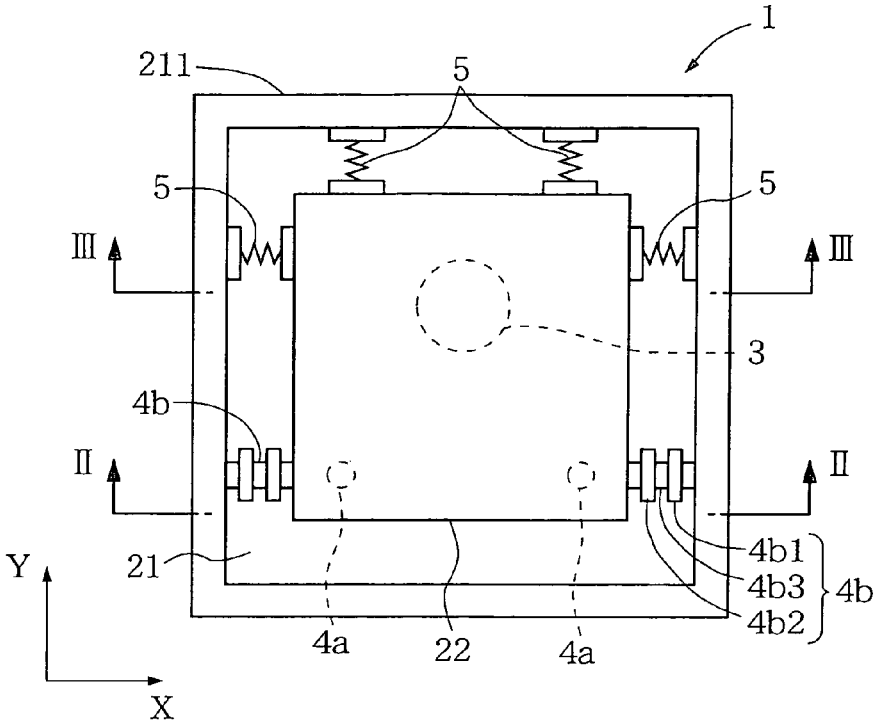
FIG. 1 is a plan view of an embodiment of an attitude control device.
Figure 2:
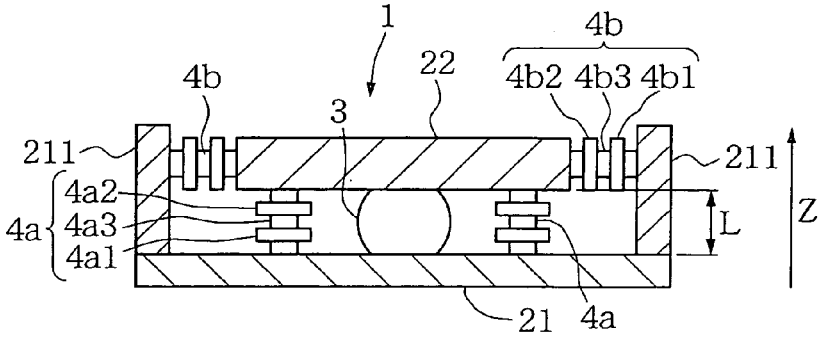
FIG. 2 is a sectional view taken along line II—II in FIG. 1.
Figure 3:
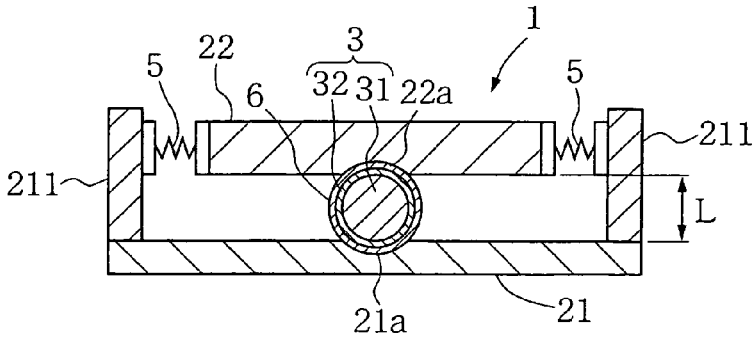
FIG. 3 is a sectional view taken along line III—III in FIG. 1.
Figure 4:
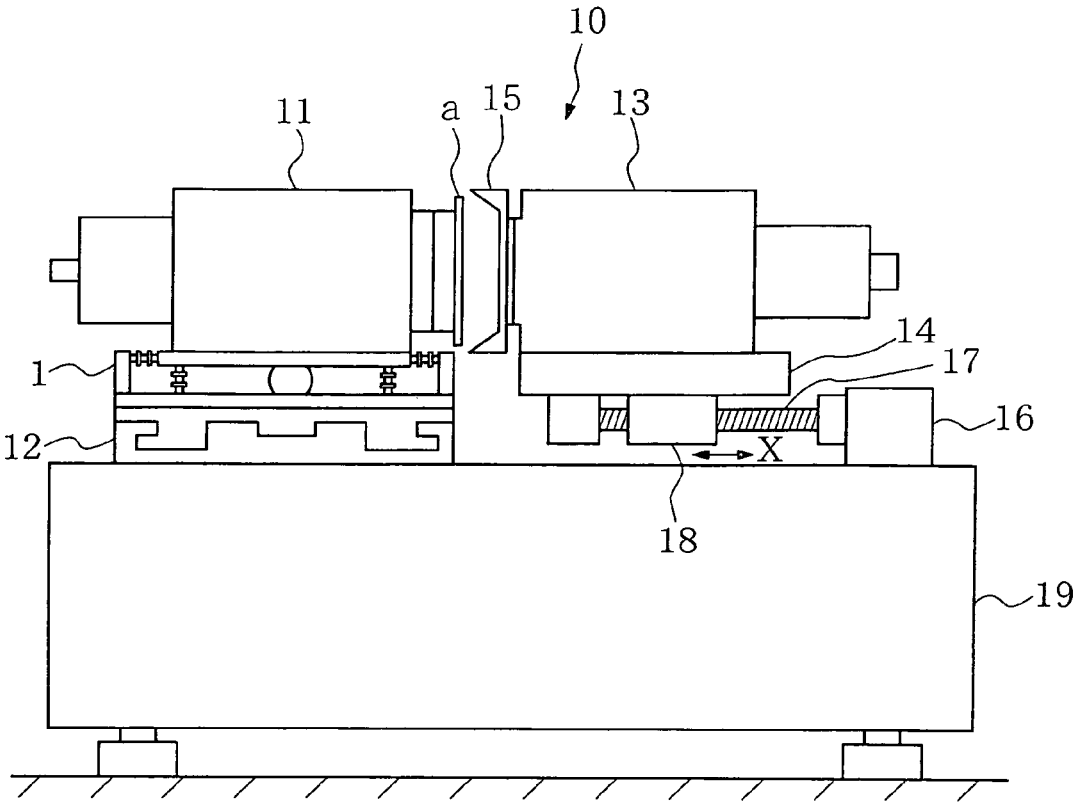
FIG. 4 is a side view of an embodiment of a precision machining apparatus.

Embodiments of the present invention will be described with reference to the accompanying drawings. FIG. 1 is a plan view of an embodiment of an attitude control device. FIG. 2 is a sectional view taken along line II—II in FIG. 1. FIG. 3 is a sectional view taken along line III—III in FIG. 1. FIG. 4 is a side view of an embodiment of a precision machining apparatus. The illustrated embodiment of the attitude control device is constituted by a pair of first actuators and a pair of second actuators. Needless to say, the number of actuators provided is not limited to that in the embodiment.

FIG. 1 shows an embodiment of the attitude control device 1, and FIG. 2 shows a sectional view taken along line II—II in FIG. 1. The attitude control device 1 has a frame open at its top and constituted by a first flat-plate member 21 and side walls 211. This frame can be made of an SUS material for example. A second flat-plate member 22 is set between pairs of side walls 211 facing each other, with the second actuators **4*b* interposed between the second flat-plate member 22 and the side wall 211. A suitable spacing L is provided between the first flat-plate member 21 and the second flat-plate member 22. The spacing L is large enough to prevent the first flat-plate member 21 and the second flat-plate member 22 from interfering with each other even when the second flat-plate member 22 is inclined. In the illustrated embodiment, a plurality of springs 5 are interposed between the side wall 211 and the second flat-plate member 22 as well as the second actuator 4*b* in order to retain the second flat-plate member 22** in the X-Y plane.

Each second actuator is constituted by an axial member **4*b*3 having suitable rigidity, a super-magnetostrictive element 4*b*1 and a piezoelectric element 4*b*2. The super-magnetostrictive element 4*b*1 is constructed by fitting a coil (not shown) around an element and is expandable by a magnetic field produced by causing a current to flow through the coil. The piezoelectric element 4*b*2 is also expandable by application of a voltage thereto. Further, a suitable current or voltage can be applied to the super-magnetostrictive element 4*b*1 or the piezoelectric element 4*b*2 according to information on the position of a mounted object (e.g., the rotary device, etc.) detected with a detection sensor (not shown). The super-magnetostrictive element 4*b*1 and the piezoelectric element 4*b*2 may be selectively operated with respect to working stages according to whether or not there is a need to move the second flat-plate member 22 comparatively largely. The super-magnetostrictive element 4*b*1 may be formed of an alloy of a rare-earth metal such as dysprosium or terbium and iron or nickel, as is that in the conventional art. The piezoelectric element 4*b*2** may be formed of lead zirconate titanate ($Pb(Zr,Ti)O_3$), barium titanate ($BaTiO_3$), lead titanate ($PbTiO_3$) or the like.

In a case where the attitude control device 1 is mounted, for example, on a flat pedestal, the second actuators **4*b* are operated when the second flat-plate member 22 is to be displaced along the X-Y plane (horizontal direction), and first actuators 4*a* are operated when the second flat-plate member 22 is to be displaced in the Z-direction (vertical direction). Each first actuator 4*a* is constituted by an axial member 4*a*3 having suitable rigidity, a super-magnetostrictive element 4*a*1 and a piezoelectric element 4*a*2, as is the second actuator 4*b***.

A spherical member 3 is interposed between the first flat-plate member 21 and the second flat-plate member 22 as well as the first actuators **4*a*. FIG. 3 shows the spherical member 3** in detail.

The spherical member 3 is constituted by a spherical core 31 made of a metal for example, and a film 32 provided on the periphery of the core 31 and formed of graphite for example. Further, a film formed of an adhesive 6 capable of elastic deformation at ordinary temperature is formed on the outer peripheral surface of the film 32. As the adhesive 6, an adhesive having a tensile shear strength of 10 to 15 Mpa, an attenuation coefficient of 2 to 7 Mpa·sec, preferably 4.5 Mpa·sec and a spring constant of 80 to 130 GN/m, preferably 100 GN/m (elastic epoxy-based adhesive) may be used. The thickness of the adhesive film may be set to about 0.2 mm.

Recesses 21*a* and 22*a* are formed as portions of the first flat-plate member 21 and the second flat-plate member 22 to be brought into contact with the spherical member 3. Portions of the spherical member 3 are fitted in the recesses 21*a* and 22*a* to position the spherical member 3. The adhesive 6 formed as a film on the outer peripheral surface of the spherical member 3 adheres to the surfaces in the recesses 21*a* and 22*a* but is separated from the spherical member 3 (the film 32 constituting the spherical member 3), so that the spherical member 3 can be freely rotated in the film of the adhesive 6.

When the attitude of any load is controlled by operating the first actuators 4*a* and the second actuators 4*b* in a state where the load is mounted on the second flat-plate member 22, the film formed of the adhesive 6 is elastically deformed to permit three-dimensional free displacement of the second flat-plate member 22. At this time, the core 31 constituting the spherical member 3 supports the weight of the load but only rotates at the fixed position without restraining the film of the adhesive 6 on its outer peripheral surface. The spherical member 3 only supports the weight of the load in its essential functioning, and the spherical member 3 and the adhesive 6 do not adhere to each other. Therefore, the adhesive 6 can elastically deform freely according to the displacement of the second flat-plate member 22 without being restrained by the spherical member 3. Thus, the second flat-plate member 22 receives only an extremely small amount of restraint corresponding to a reaction force in elastic deformation of the adhesive 6.

An embodiment of a precision machining apparatus 10 incorporating the above-described attitude control device 1 will be described with reference to FIG. 4.

The precision machining apparatus 10 is, for example, a grinding apparatus capable of consistently performing a process from rough grinding to final precision grinding (final finishing) on an object a to be ground such as a silicon wafer. Main components provided on a base 19 constituting the precision machining apparatus 10 are a first rotary device 13 for rotating a grinding wheel 15, a first pedestal 14 supporting the rotary device 13, a second rotary device 11 for rotating the object a to be ground while holding the object a, and a second pedestal 12 supporting the rotary device 11.

The first pedestal 14 is fixed on a nut 18 screw-threaded on a feed screw 17 attached to an output shaft of a servo motor 16. The first rotary device 13 can be moved toward the object a to be ground (in the direction of arrow X) with the movement of the nut 18.

The above-described attitude control device 1 is mounted between the second pedestal 12 and the second rotary device 11.

The grinding wheel 15 can be replaced at a grinding stage. For example, a diamond grinding wheel is used at the time of rough grinding, and a CMG grinding wheel can be used at a final surface finishing stage. At the time of rough grinding in this grinding method, the surface of the object a to be ground is roughly ground according to the movement of the nut 18. At the time of final finishing, final finishing grinding can be performed while adjusting from one level to another the pressure of the first rotary device 13 against the object a to be ground. In the entire process from the rough grinding step to the final grinding step, grinding is performed while the attitude control device 1 is suitably adjusting a misalignment between the axes of the first rotary device 13 and the second rotary device 11. By the above-described CMG machining process, the tip which has the degree of flatness of 10 to 20 nm/inch was obtained.

The embodiments of the present invention have been described in detail with reference to the drawings. However, the concrete construction of the invention is not limited to the embodiments. Various changes in the design or the like may be made without departing from the gist of the present invention. The present invention encompasses such changes.

What is claimed is:

1. An attitude control device used to control the attitude of a mounted object, the attitude control device comprising:

a first flat-plate member extending in a plane defined by an X-axis and a Y-axis;

a second flat-plate member disposed in parallel with the first flat-plate member while being spaced apart from the same, recesses being formed in surfaces of the two flat-plate members facing each other;

a spherical member interposed between the first flat-plate member and the second flat-plate member while fitting its portions in the recesses;

a first actuator interposed between the first flat-plate member and the second flat-plate member, the first actuator being expandable in a Z-axis direction perpendicular to the plane defined by the X-axis and the Y-axis; and a second actuator connected to the second flat-plate member, the second actuator being expandable in a suitable direction in the plane defined by the X-axis and the Y-axis, wherein the second flat-plate member is movable relative to the first flat-plate member while being in an attitude with an object mounted thereon, and the spherical member is bonded to the first flat-plate member and/or the second flat-plate member by an adhesive elastically deformable.

2. The attitude control device according to claim 1, wherein a film of the adhesive is formed on the surface of the spherical member, and the spherical member and the film of the adhesive are separated from each other to be movable relative to each other.

3. The attitude control device according to claim 1 or 2, wherein a piezoelectric element and a super-magnetostrictive element are provided in each of the first actuator and the second actuator.

4. A precision machining apparatus comprising:

a first rotary device for rotating a grinding wheel;

a first pedestal supporting the first rotary device;

a second rotary device for rotating an object to be ground; and a second pedestal supporting the second rotary device, wherein the attitude control device according to any one of claims 1 to 3 is provided between the first rotary device and the first pedestal or between the second rotary device and the second pedestal.

* * * * *